United States Patent [19]

Crow et al.

[11] 4,192,500

[45] Mar. 11, 1980

[54] RACQUET GAME EXERCISER

[76] Inventors: Dennis W. Crow; William E. Kreger, both of 3019 Mac Heath Crescent, Flossmoor, Ill. 60422

[21] Appl. No.: 895,152

[22] Filed: Apr. 10, 1978

[51] Int. Cl.[2] ..... A63B 11/08

[52] U.S. Cl. ..... 272/68; 272/117; 272/142

[58] Field of Search ..... 272/68, 122, 124, 117, 272/142, 143, DIG. 4; 273/29 A

[56] References Cited

U.S. PATENT DOCUMENTS

| | | | |
|---|---|---|---|
| 3,351,346 | 11/1967 | Strahan | 272/124 X |
| 3,414,260 | 12/1968 | Gust | 272/124 |
| 3,687,458 | 8/1972 | Proctor, Jr. | 272/68 X |
| 4,021,040 | 5/1977 | Inoue | 272/68 X |

FOREIGN PATENT DOCUMENTS

| | | | |
|---|---|---|---|
| 305995 | 7/1915 | Fed. Rep. of Germany | 272/68 |
| 598554 | 10/1959 | Italy | 272/122 |

*Primary Examiner*—Richard C. Pinkham
*Assistant Examiner*—Scott L. Brown

[57] ABSTRACT

An improved apparatus capable of being employed by a single human user, to example, to improve his or her ability at any or all of a number of racquet games, comprises an elongated member having a weight; and a hand grip including at least two elements which are influenced, e.g., by one or more springs, to be apart. The user by grasping these elements and squeezing them together while simulating forehand and/or backhand racquet strokes obtains substantial benefits, e.g., improved grip and arm strength, improved coordination and improved racquet game proficiency.

9 Claims, 4 Drawing Figures fig.1.
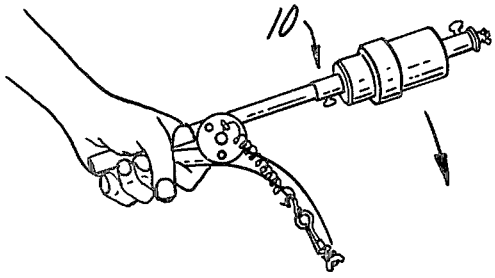
fig.2.
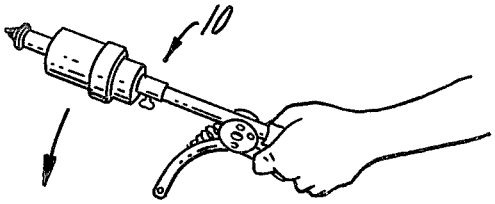
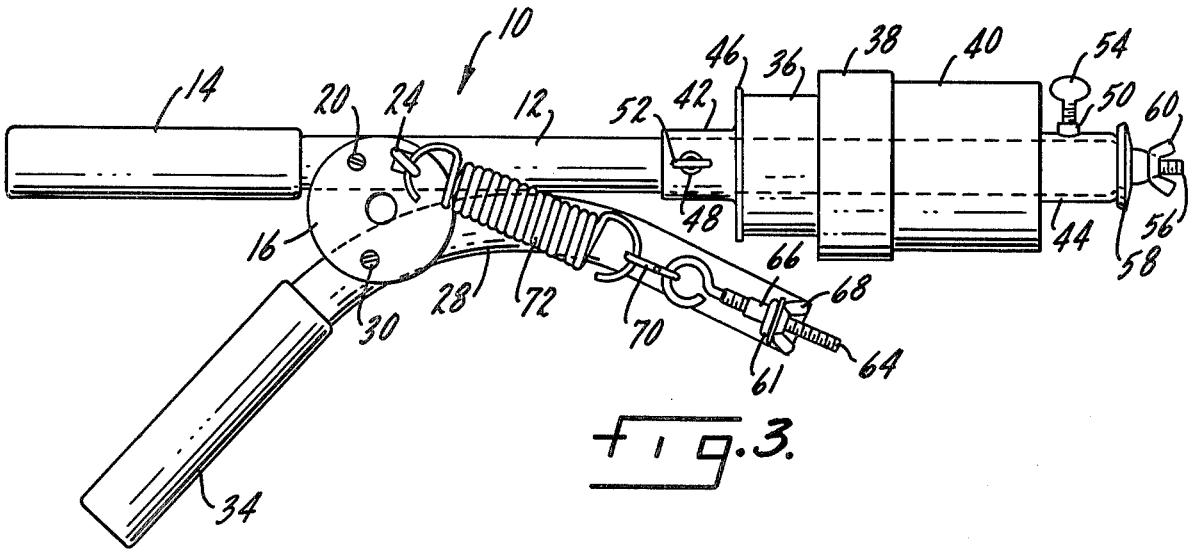
fig.3.
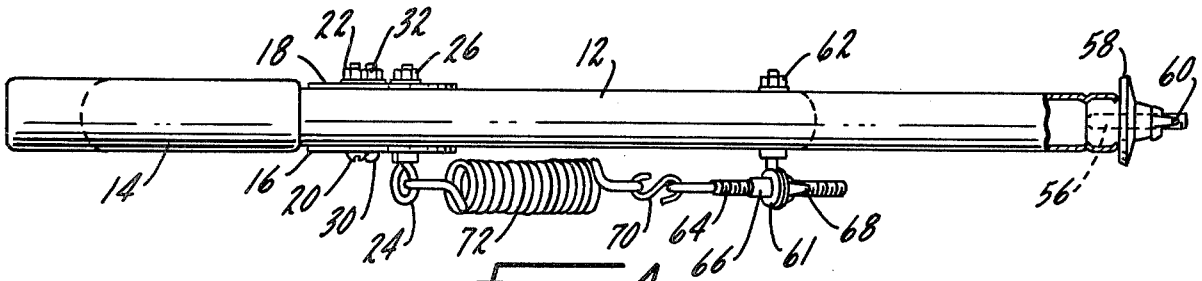
fig.4.

RACQUET GAME EXERCISER

The present invention relates to an improved apparatus useful as an exercising and/or improvement aid. More particularly, this invention relates to an improved apparatus useful by a single human being to improve his or her strength and/or ability at any or all of a number or racquet games.

The 1970's have seen a boom in recreational activities. One area which has seen particularly rapid growth is racquet games or sports. Games such as tennis, racquet ball, squash, platform tennis and the like all involve the use of racquets of one sort or another.

Such games provide exercise for the entire body. However, the hand and arm, and in some cases both of the hands and arms, of the game player are subject to particular strain. A firm hand grip, as well as strength and flexibility in the wrist, elbow and shoulder joints and associated muscles, tendons, etc. are beneficial to ones proficiency in these games.

Frequently, players do not participate in a given racquet game often enough to develop and/or maintain hands and arms in proper condition. For example, it is often difficult to find a playing partner or an available playing area or both. Players who are not in condition have a reduced chance of improving their game proficiency and an increased chance of damaging their bodies, in particular their hands and arms. Conditions such as "tennis elbow" often result.

One exercise procedure which has been suggested to racquet game players is weight training. Weights of varying sizes are held in the hand and the wrist, elbow and/or shoulder joints are flexed. Procedures of this type do add arm strength. However, such training does not emphasis grip strength and coordination which, as noted above, aid racquet game proficiency. Clearly, an improved exerciser useful by a single racquet game player is desirable.

Therefore, one object of the present invention is to provide an improved apparatus useful as an aid to racquet game players.

Another object of the present invention is to provide an exercise apparatus which can be used by a single person.

A still further object of this invention is to provide an exercise apparatus to maintain or improve the hand grip strength of the user.

An additional object of the invention is to provide an exercise apparatus to maintain or improve the arm strength of the user.

A further object of this invention is to provide an exercise apparatus to maintain or improve the coordination of the user.

An added object of the present invention is to provide an apparatus which is useful as an aid in the recovery from sore arm conditions, such as "tennis elbow".

Yet another object of the present invention is to provide an exercise apparatus to maintain or improve the proficiency of the user in one or more racquet games. These and other objects and advantages of the present invention will become apparent hereinafter.

An improved apparatus capable of being used, e.g., as an exercising aid, by a single human being has now been discovered. The apparatus comprises an elongated member having a given weight. Positioned in association with the elongated member is a grip system including at least two elements which are capable of being grasped in one hand by the user. At least one of these elements is moveable by the human user, e.g., while the elements are being grasped in the hand of the user, toward at least one of the other elements. By so grasping, the user is able to hand hold both the elongated member and the grip system. The grip system further includes a bias mechanism which acts to urge the elements of the grip system apart.

One suggested method for using the present apparatus involves the user grasping the elements of the grip system in one hand. The user squeezes the elements together against the force of the bias mechanism. At the same time, the user swings the elongated member and grip system to simulate forehand and/or backhand racquet game strokes. Preferably, the user continueously alternates simulations of the forehand and backhand strokes.

Outstanding simultaneous benefits, e.g., to the user, are obtained with the present apparatus. Squeezing the biased elements provides grip strength, while swinging the weighted elongated member and grip system to simulate actual racquet game strokes provides wrist, arm and shoulder strength, and coordination.

In one preferred embodiment, the present apparatus further comprises one or more weights locatable in association with the elongated member a distance away from the elements. One or more of these weights can be added to the apparatus to provide the exerciser with additional weight as desired. For example, men may wish to include a substantial amount of such additional weight whereas women may not want any additional weight on the exerciser. Preferably, these weights may be added to or removed from the apparatus, e.g., to or from the elongated member, to adjust the weight of the apparatus as desired, for example, to suit the current needs of the particular user involved. In addition, at least one, and more preferably all, of the additional weights are preferably adjustably located with respect to the elements of the present apparatus, for example, along the elongated member, to add still further flexibility to the present apparatus.

As noted above, the present apparatus includes an elongated member. Preferably, the elongated member has sufficient length so that the length of the apparatus is in the range of about 6 inches to about 3 feet, more preferably about 1 foot to about 2.5 feet. Such lengths provide for improved simulation of racquet game strokes by the user. The elongated member may have any suitable configuration, e.g., circular, square, oval, angular cross-section and the like, with a substantially circular cross-section being preferred.

In one preferred embodiment, at least one of the elements of the grip system is located at or near one end of the elongated member. A particularly preferred construction involves one of these elements being located at one end of the elongated member with at least one other element being pivotably mounted on the elongated member. Thus, one of the elements of the grip system may be one end of the elongated member.

In embodiments in which weight or weights may be added to or removed from the apparatus and/or moved, e.g., on the elongated member, closer to or further away from the elements, such weight or weights are preferably oriented with respect to the elongated member so that the weight or weights, when included on the apparatus, are substantially symetrically distributed around the longitudinal axis of the elongated member. Such distribution gives the apparatus improved balance. In one preferred embodiment, such distribution may be obtained by providing weights in the shape of substantially uniform donuts, with the central hole sized so that the elongated member can be passed therethrough. In this construction, the elongated member is provided with at least one detachable stop which can be removed to allow weight to be added to or removed from the apparatus and/or at least one weight positioning means located in association with the elongated member to hold the weight or weights in position relative to the elongated member a desired distance away from the elements. With the stop and positioning means in place on the present apparatus, the weights, e.g., donut-shaped weights, if any, which are included in the apparatus, e.g., surrounding the elongated member, are held securely in place on the elongated member.

The weights themselves may be made of any suitable material and preferably are in the range of about ½ pound to about 15 pounds. Preferably, the apparatus is equipped with a plurality of such weights weighing differently. Thus, by picking and choosing the proper weights to be included on the apparatus for use, the user provides the exerciser with the desired weight. In order to reduce the bulk of the weights, they are preferably made of metal, with lead and cast iron being particularly preferred. The weights may be painted or otherwise covered as desired, e.g., for cosmetic purposes.

The present grip system includes at least two elements and preferably only two elements, which are capable of being grasped in one hand by the human user of the exerciser. In certain instances, the elements may be provided with a cover surrounding the elements so that the user grips the cover and is not aware of the plurality of elements involved. Alternately, the elements may be provided with materials, such as rubber, foam, cloth composition, plastic and the like conventional material which provide improved confort to the gripping hand of the user.

When not in use, the elements of the grip system are apart, e.g., separated, at least partially in response to the urging of the bias mechanism, described in detail hereinafter. In any event, at least one of these elements is capable of being moved by the human user, e.g., while the elements are being grasped in the hand of the user, toward at least one of the other elements. By grasping or gripping the elements of the grip system, the user is able to hold in one hand the elongated member, additional weights, if any, and the grip system.

The bias mechanism of the grip system acts to urge the elements apart. Thus, when the user grasps the elements and squeezes them together, he or she is working against this bias mechanism. The force exerted on the elements by the bias mechanism ultimately tends to improve the hand grip strength of the human user. Preferably, the effective force of the bias mechanism acting to urge the grip system elements apart is adjustable, more preferably adjustable over a substantially continuous range. That is, the user can adjust the force of the bias mechanism to suit his or her own current needs, desires and capabilities. Any suitable bias mechanism may be employed in the present apparatus.

In a preferred embodiment, the bias mechanism includes at least one, more preferably a single, spring member. For example, coiled springs capable of producing about 0.5 foot-pound to about 50 foot-pounds of force may be employed with particular advantage. The apparatus may be equipped with a series of spring members of differing strength so that the user may adjust the force of the bias mechanism by picking and choosing one or more of these different spring members for inclusion in the exerciser to be used to obtain the bias force desired. Alternately, and preferably, the bias mechanism includes one spring member which is constructed and located on the exerciser so that the effective force provided by the spring member can be adjusted over a substantially continuous range. This feature provides for improved flexibility, ease of operation and allows the user to accurately select the amount of bias force desired.

In general, and except as otherwise provided for herein, the apparatus of the present invention may be fabricated from any suitable material or combination of materials of construction. The material of construction used for each component of the present apparatus may be dependent upon the particular application involved. Of course, the apparatus should be made of material which are substantially unaffected, except for normal wear and tear, by the conditions at which the apparatus is normally operated. In addition, such material or materials should have no substantial deletorious effect on the human user or users of this apparatus.

These and other aspects and advantages of the present invention are set forth in the following detailed description and claims, particularly when considered in conjunction with the accompanying drawings in which like parts bear like reference numerals. In the drawings:

FIG. 1 is an illustration of one embodiment of the present apparatus being used to simulate a forehand tennis stroke.

FIG. 2 is an illustration of this apparatus being used to simulate a backhand tennis stroke.

FIG. 3 is a front elevated view of the apparatus shown being used in FIGS. 1 and 2; and FIG. 4 is a top plan view, partly in section, of this apparatus, with certain components deleted for illustrative purposes.

Referring now to the drawings, the embodiment of the present exerciser, referred to generally as 10, includes shaft 12 with first handle member 14 located at one end thereof. Circular discs 16 and 18 are attached to shaft 12 by means of screw 20 and nut 22, and hook 24 and nut 26. If desired, hook 24 and nut 26 can be fastened directly to shaft 12, i.e., without involving discs 16 and 18. Discs 16 and 18 are also pivotably attached to curved piper 28 by means of screw 30 and nut 32. Curved pipe 28 is provided with second handle member 34 located at one end thereof. Both first handle member 14 and second handle member 34 are wrapped with cushioning material to provide improved comfort for the human user's hand.

Toward the end of shaft 12 away from first handle member 14 there is located a series of donut-shaped lead weights 36, 38 and 40. Each of these lead weights 36, 38 and 40 is of a different size. The central hole in each of these lead weights 36, 38 and 40 fit snuggly around shaft 12. In this manner the weight of weights 36, 38 and 40 is substantially symetrically distributed around the longitudinal axis of shaft 12.

Weights 36, 38 and 40 are held in place surrounding shaft 12 with opposing collars 42 and 44 and plate 46. Collars 42 and 44 are provided with threaded holes 48 and 50, respectively. Screw members 52 and 54 are inserted into threaded holes 48 and 50, respectively, and tightened until collars 42 and 44 are securely fastened to shaft 12. The position of weights 36, 38 and 40 can be adjusted along shaft 12 simply by loosening collars 42 and 44, moving weights 36, 38 and 40 and collars 42 and 44 to a new desired position on shaft 12 and, then, fastening collars 42 and 44 to shaft 12 as described above.

Threaded peg 56 is securely anchored to the material inside shaft 12 and extends a short distance beyond the end of shaft 12. Plug 58 having a diameter greater than that of collar 44 and a central hole capable of receiving peg 56, is placed on peg 56 and moved to an abutting position with respect to the end of shaft 12 and collar 44. Wing nut 60 is placed on peg 56 and tightened to secure plug 58 in the above-described abutting position.

A second hook 61 is passed through curved pipe 28 and attached thereto by nut 62. Threaded hook 64 is passed through second hook 61. Stabilizing element 66 is also passed through second hook 61 between second hook 61 and threaded hook 64 and acts to prevent the threads of threaded hook 64 from coming into contact with and being damaged by second hook 61. Wing nut is placed on threaded hook 64 in abutting position with respect to stabilizing element 66. With this construction, turning wing nut 68 causes threaded hook 64 to move in one direction or the other through second hook 61.

The loop portion of threaded hook 64 is linked with one section of S-shaped element 70. The other section of S-shaped element 70 is linked to one end of spring 72. The other end of spring 72 is linked through hook 24. If desired, spring 72 and the components linked to it may be covered, e.g., for safety reasons. In addition, the position of the spring mechanism can be reversed so that wing nut 68 is toward the end of the mechanism near shaft 12, rather than as shown in the drawings.

Spring 72, acting through the mechanism just described urges first handle member 14 and second handle member 34 apart. The effective force that spring 72 provides to urge first handle member 14 and second handle member 34 apart is adjustable of a substantially continuous range. Thus, wing nut 68 can be turned in one direction or the other causing the distance between S-shaped element 70 and hook 24 to increase or decrease, which, in turn, cause spring 72 to expand or contract. In general, as spring 72 is expanded, the amount of effective force urging first handle member 14 and second handle member 34 apart is increased. In this manner, the amount of this effective force can be adjusted to suit the desire of the particular user.

Exerciser 10 may be used as follows. Prior to use, the individual user may adjust the weights 36, 38 and 40, and/or may adjust the effective force urging first handle member 14 and second handle member 34 apart by appropriately turning wing nut 68.

Once the user is satisfied with the weight and urging force of the exerciser 10, he or she grasps both first handle member 14 and second handle member 34 in one hand and squeezes them together, against the urging force of spring 72. With first handle member 14 and second handle member 34 being squeezed together, the user simulates a forehand tennis stroke, as shown in FIG. 1, followed immediately by a simulation of a backhand tennis stroke, as shown in FIG. 2. This cycle of forehand and backhand simulations is continued for a period of time, e.g., for as long as the user can hold first handle member 14 and second handle member 34 together. After a short rest period, the exercise cycle can be repeated.

The present apparatus provides substantial benefits to the user. Improved hand grip strength is possible because of the work being done against the bias mechanism, e.g., spring 72. The weight of the exerciser 10, and that of the added weights 36, 38 and 40, help to develop improved wrist, elbow, arm and shoulder strength. The continuous simulations of forehand and backhand racquet game strokes using exerciser 10 can result in improved coordination. In short, the present apparatus promotes improved racquet game proficiency.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. An apparatus capable of being employed by a single human user comprising an elongated member having a weight and a substantially straight longitudinal axis; weight means locatable toward one end of said elongated member to provide additional weight to said apparatus; and grip means positioned in association with said elongated member, said grip means including two elements capable of being grasped in one hand by said human user to hand hold said apparatus, one of said elements being located at or near the end of said elongated member away from said weight means and having substantially the same longitudinal axis as said elongated member, said elements being movable toward each other by said human user, said grip means further including bias means acting to provide force to urge said elements apart, said bias means being structured to allow said force to be adjustable over a substantially continuous range.

2. The apparatus of claim 1 wherein said weight means is oriented with respect to said elongated member so that said additional weight is substantially symetrically distributed around the longitudinal axis of said elongated member.

3. The apparatus of claim 2 wherein the position of at least a portion of said weight means relative to said elements is adjustable.

4. The apparatus of claim 2 wherein said elongated member and weight means are constructed so that at least a portion of said weight means surrounds said elongated member.

5. The apparatus of claim 4 wherein said weight means includes at least two different sized weights which can be individually removed or added around said elongated member to adjust the weight of said apparatus as desired and the position of each of said weights is adjustable along said elongated member.

6. The apparatus of claim 1 wherein the weight of said apparatus is adjustable.

7. The apparatus of claim 1 wherein at least a portion of said weight means is removeable from said apparatus.

8. The apparatus of claim 1 wherein said bias means includes at least one spring member.

9. The apparatus of claim 1 wherein said bias means includes one spring member.

* * * * *